US009921545B2

(12) United States Patent
Miyamoto

(10) Patent No.: US 9,921,545 B2
(45) Date of Patent: Mar. 20, 2018

(54) UNIT DETACHABLE ALONG AN INSERTION/REMOVAL TRAJECTORY FORMED IN AN IMAGE FORMING APPARATUS MAIN BODY, AND IMAGE FORMING APPARATUS THEREWITH

(71) Applicant: KYOCERA Document Solutions Inc., Osaka (JP)

(72) Inventor: Takuya Miyamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/419,324

(22) Filed: Jan. 30, 2017

(65) Prior Publication Data

US 2017/0242395 A1 Aug. 24, 2017

(30) Foreign Application Priority Data

Feb. 23, 2016 (JP) ..... 2016-031560

(51) Int. Cl.
*G03G 21/18* (2006.01)

(52) U.S. Cl.
CPC ..... *G03G 21/1842* (2013.01)

(58) Field of Classification Search
CPC ..... G03G 21/1842; G03G 21/1846; G03G 21/1839; G03G 21/1853
USPC ..... 399/111
See application file for complete search history.

(56) References Cited

U.S. PATENT DOCUMENTS 6,061,538 A * 5/2000 Arimitsu ..... G03G 21/1853 399/111
6,173,145 B1 * 1/2001 Chadani ..... G03G 15/0935 399/265
6,640,066 B2 * 10/2003 Sato ..... G03G 21/1814 399/106
2007/0242977 A1 10/2007 Suzuki ..... 399/113

FOREIGN PATENT DOCUMENTS

JP 2007-310378 A 11/2007

* cited by examiner

*Primary Examiner* — Billy Lactaoen
(74) *Attorney, Agent, or Firm* — Stein IP, LLC

(57) ABSTRACT

A detachable unit has a unit housing and a grip portion thereon. The detachable unit is insertable and removal along an insertion/removal trajectory formed inside the body of an image forming apparatus and forming a depression angle as seen from the removal direction. The grip portion has a pressed face facing the upstream side of the unit housing in its removal direction and substantially perpendicular to the insertion/removal trajectory, a first side extending along the lower-end edge of the pressed face, and a second side extending along the upper-end edge of the pressed face. No face extending on the upstream side of the unit housing in the removal direction connects to the first side, and a finger insertion portion into which a finger can be inserted from the side of the first side along the pressed face is formed in the first side.

10 Claims, 7 Drawing Sheets

UNIT DETACHABLE ALONG AN INSERTION/REMOVAL TRAJECTORY FORMED IN AN IMAGE FORMING APPARATUS MAIN BODY, AND IMAGE FORMING APPARATUS THEREWITH

INCORPORATION BY REFERENCE

This application is based upon and claims the benefit of priority from the corresponding Japanese Patent Application No. 2016-31560 filed on Feb. 23, 2016, the entire contents of which are incorporated herein by reference.

BACKGROUND

The present disclosure relates to a detachable unit that is detachably attached to an image forming apparatus adopting electrophotography, such as a copier, printer, facsimile machine, or multifunction peripheral incorporating those. More particularly, the present disclosure relates to the structure of a grip portion in a removably attached unit.

In conventional image forming apparatuses, because of the lifetime of a photosensitive drum (image carrier), when the number of sheets printed reaches a predetermined number (for example, several tens of thousands of sheets), the photosensitive drum (image carrier) needs to be replaced. A developing device arranged adjacent to the photosensitive drum may also need maintenance or replacement.

To cope with that, a photosensitive drum and a developing device are built into a unit, and various mechanisms have been devised that allow such a unit to be attached and removed easily. For example, an image forming apparatus is known in which a photosensitive unit including a photosensitive member is configured to be removably attached in an image forming position in a body casing, and a developing unit is configured to be removably attached to the photosensitive unit, wherein the photosensitive unit is provided with a photosensitive unit-side guide portion, a body guide portion for the developing unit is formed on the body casing, and the body guide portion for the developing unit is formed to be continuous with the photosensitive unit-side guide portion.

SUMMARY

According to one aspect of the present disclosure, a detachable unit includes a unit housing and a grip portion formed on the unit housing. The detachable unit is insertable and removal along an insertion/removal trajectory that is formed inside the main body of an image forming apparatus so as to form a depression angle as seen from the removal direction. The grip portion has a pressed face which faces the upstream side of the unit housing in its removal direction and which is substantially perpendicular to the insertion/removal trajectory, a first side which extends along the lower-end edge of the pressed face, and a second side which extends along the upper-end edge of the pressed face. No face that extends on the upstream side of the unit housing in its removal direction connects to the first side, and a finger insertion portion into which a finger can be inserted from the side of the first side along the pressed face is formed in the first side.

Further features and advantages of the present disclosure will become apparent from the description of embodiments given below.

DETAILED DESCRIPTION

Figure 1:
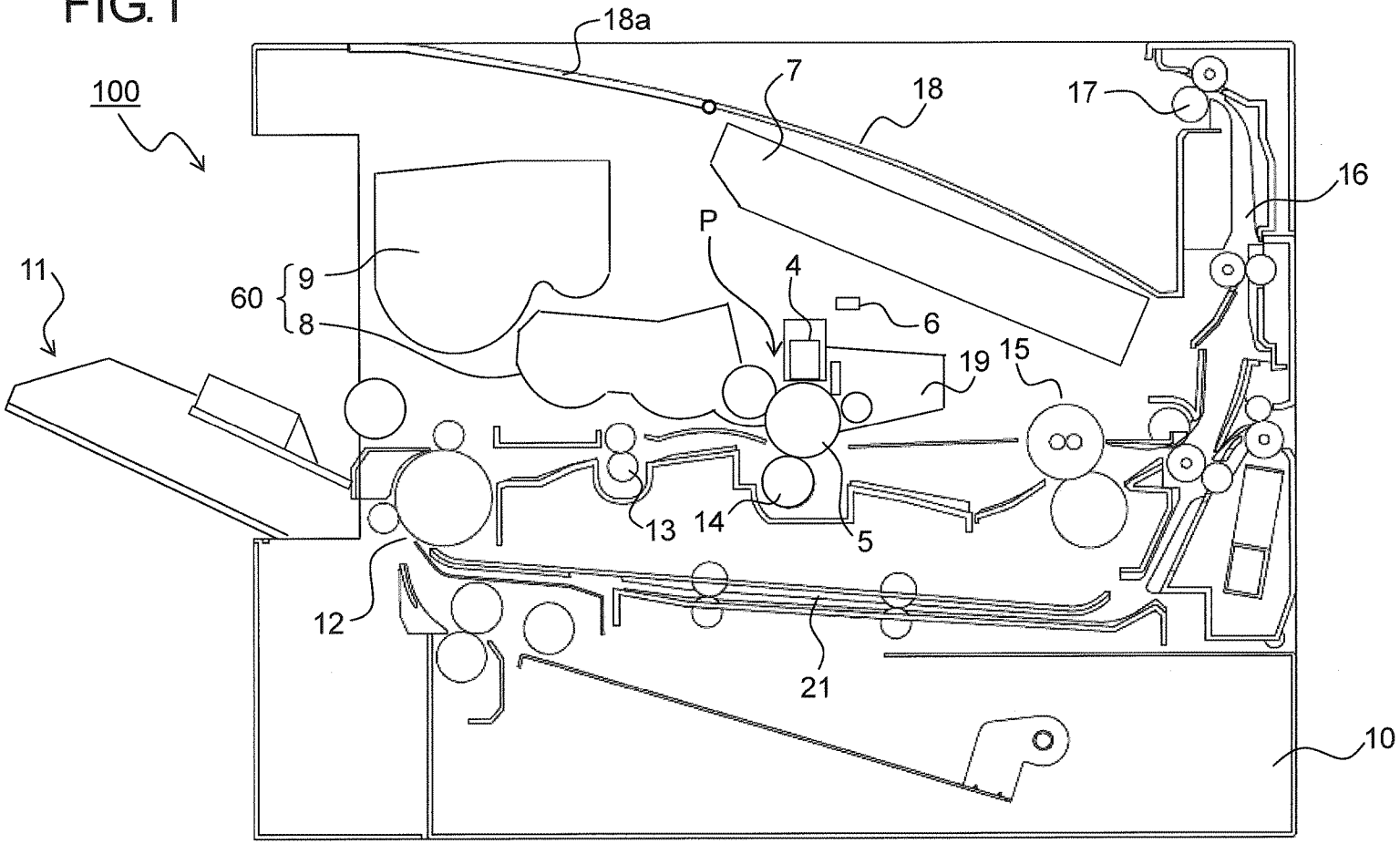
FIG. 1 is a side sectional view showing an internal structure of an image forming apparatus provided with a drum unit according to the present disclosure.

Embodiments of the present disclosure will be described below with reference to the accompanying drawings. FIG. 1 is a side sectional view showing an internal structure of an image forming apparatus 100 provided with a drum unit 30 according to the present disclosure. Inside the image forming apparatus 100 (here, a monochrome printer), an image forming section P which forms a monochrome image through the processes of electrostatic charging, exposure to light, image development, and image transfer is arranged. In the image forming section P, a charging device 4, an exposure unit (such as a laser scanning unit) 7, a developing device 8, a transfer roller 14, a cleaning device 19, and a destaticizing device 6 are arranged along the rotation direction (counter-clock direction in FIG. 1) of a photosensitive drum 5.

When an image forming operation is performed, the photosensitive drum 5 which rotates in the counter-clock direction is electrostatically charged uniformly by the charging device 4; then by a laser beam from the exposure unit 7 based on document image data, an electrostatic latent image is formed on the photosensitive drum 5; and then by the developing device 8, developer (hereinafter referred to as toner) is attached to the electrostatic latent image to form a toner image.

The toner is fed to the developing device 8 from a toner container 9. The image data is transmitted from a host device such as a personal computer (not shown) to the image forming apparatus 100. The destaticizing device 6 which removes residual electric charge on the surface of the photosensitive drum 5 is provided on the downstream side of the cleaning device 19 in the rotation direction of the photosensitive drum 5.

The charging device 4, the photosensitive drum 5, and the cleaning device 19 are built into a unit, and the developing device 8 and the toner container 9 are built into a unit. In the following description, the unit composed of the charging device 4, the photosensitive drum 5, and the cleaning device 19 will be referred to as a drum unit 30 (see FIG. 2), and the unit composed of the developing device 8 and the toner container 9 will be referred to as a developing unit 60. The drum unit 30 and the developing unit 60 are each detachably attached to the main body of the image forming apparatus 100.

Toward the photosensitive drum 5 having the toner image formed as described above, a sheet is conveyed from a sheet cassette 10 or a manual sheet feed device 11 via a sheet conveyance passage 12 and a pair of registration rollers 13, and the toner image formed on the surface of the photosensitive drum 5 is transferred to the sheet by the transfer roller 14 (an image transfer section). The sheet having the toner image transferred to it is separated from the photosensitive drum 5 and is conveyed to a fixing device 15, where the toner image is fixed. The sheet having passed through the fixing device 15 is conveyed to an upper part of the apparatus through a sheet conveyance passage 16, and is, as it is (or after being conveyed to a reversal conveyance passage 21 to be printed on both sides), discharged onto a discharge tray 18 by a pair of discharge rollers 17.

At the top face of the image forming apparatus 100, an openable cover 18*a* which constitutes a part of the discharge tray 18 is provided. With the openable cover 18*a* open, the drum unit 30 and the developing unit 60 can be inserted into and removed from the main body of the image forming apparatus 100.

Figure 2:
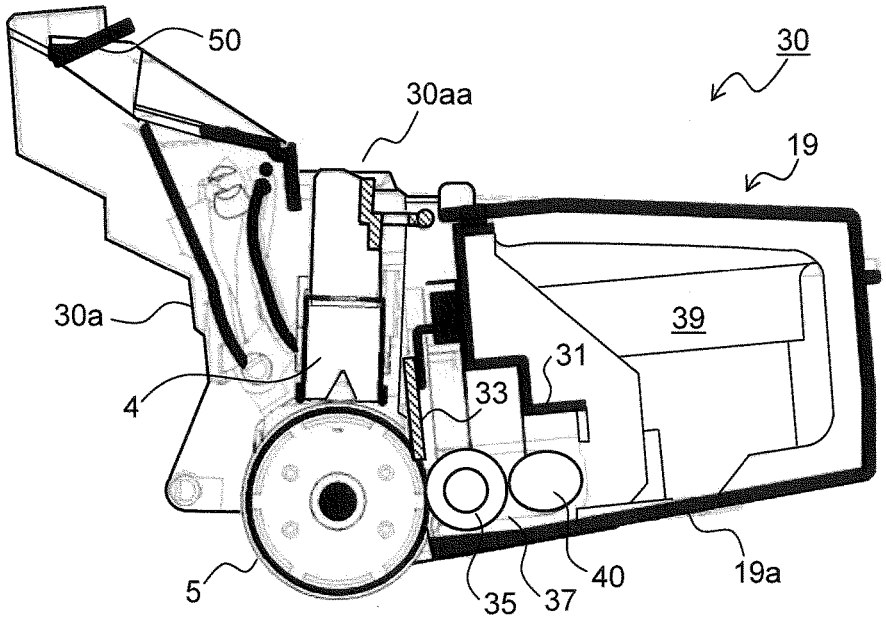
FIG. 2 is a side sectional view of the drum unit according to a first embodiment of the present disclosure.
Figure 3:
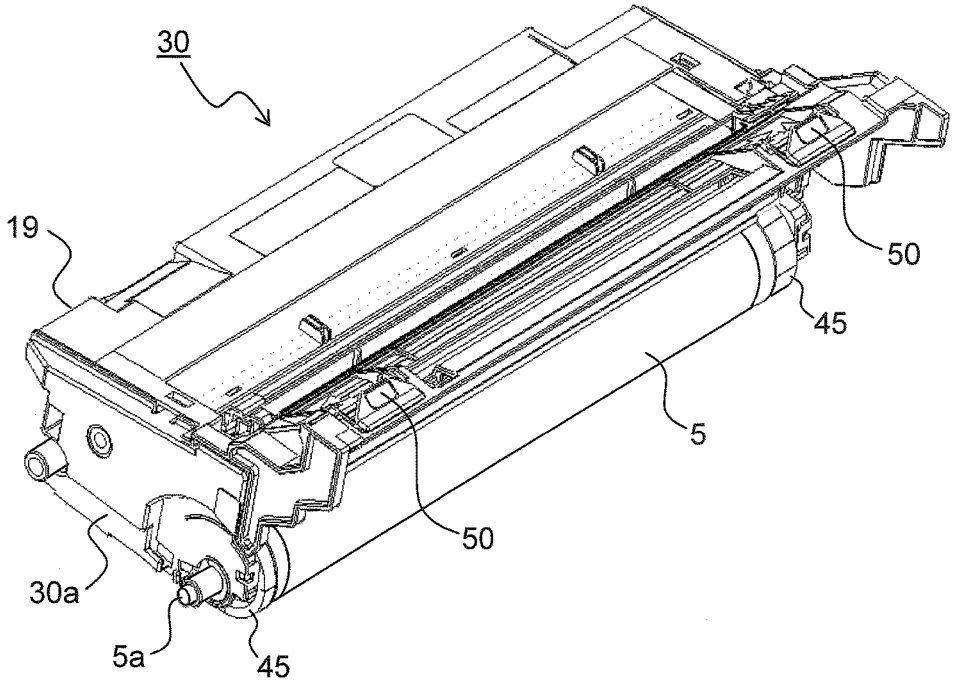
FIG. 3 is an exterior perspective view of the drum unit according to the first embodiment as seen from the downstream side in the removal direction.

FIG. 2 is a side sectional view of the drum unit 30 according to a first embodiment of the present disclosure which is incorporated in the image forming apparatus 100, and FIG. 3 is an exterior perspective view of the drum unit 30 according to the first embodiment as seen from the downstream side (left side in FIG. 2) in the removal direction.

The drum unit 30 holds the photosensitive drum 5, the charging device 4, and the cleaning device 19 integrally in a unit housing 30*a*. A housing 19*a* of the cleaning device 19, which has an opening to a side of the photosensitive drum 5, constitutes a part of the unit housing 30*a*. The inside of the housing 19*a* is partitioned into two parts by a partition wall 31, and on the photosensitive drum 5 side of the partition wall 31, a toner scraping portion 37, in which a cleaning blade 33 and a cleaning roller 35 are arranged, is provided.

On the opposite side of the partition wall 31 from the toner scraping portion 37, a waste toner storage portion 39, in which waste toner scraped off the photosensitive drum 5 by the cleaning blade 33 and cleaning roller 35 is stored, is provided. The toner scraping portion 37 and the waste toner storage portion 39 communicate with each other under the partition wall 31, and a sweep roller 40 which feeds the waste toner in the toner scraping portion 37 into the waste toner storage portion 39 is provided.

The charging device 4 is arranged to face the photosensitive drum 5 over substantially the entire range of the photosensitive drum 5 in its longitudinal direction (direction perpendicular to the plane of FIG. 2). The charging device 4 is of a scorotron type, meaning that it has a shielding member (a casing with a U-shaped cross section having an open part toward the surface of the photosensitive drum 5), a corona wire to which a high voltage is applied, and a grid provided in the open part of the shielding member (none of these are illustrated), and is configured to electrostatically charge the surface of the photosensitive drum 5 with a predetermined positive potential (the same polarity as toner) via the grid by corona discharge from the corona wire. The charging device 4 is detachably attached to the drum unit 30 for maintenance and replacement, can be removed from the unit housing 30*a* by being drawn out through an opening 30*aa* formed in an upper part of the unit housing 30*a*, and can be attached to the unit housing 30*a* by being inserted through the opening 30*aa*.

In an end part of the unit housing 30*a* on the downstream side (left side in FIG. 2, front-right side in FIG. 3) in its removal direction, a pair of grip portions 50 is formed. The grip portions 50 are parts that are gripped when the drum unit 30 is removed out of the image forming apparatus 100. Each of the grip portions is formed at each of both end parts of the unit housing 30*a* in its width direction. The structure of the grip portions 50 will be described in detail later.

Figure 4:
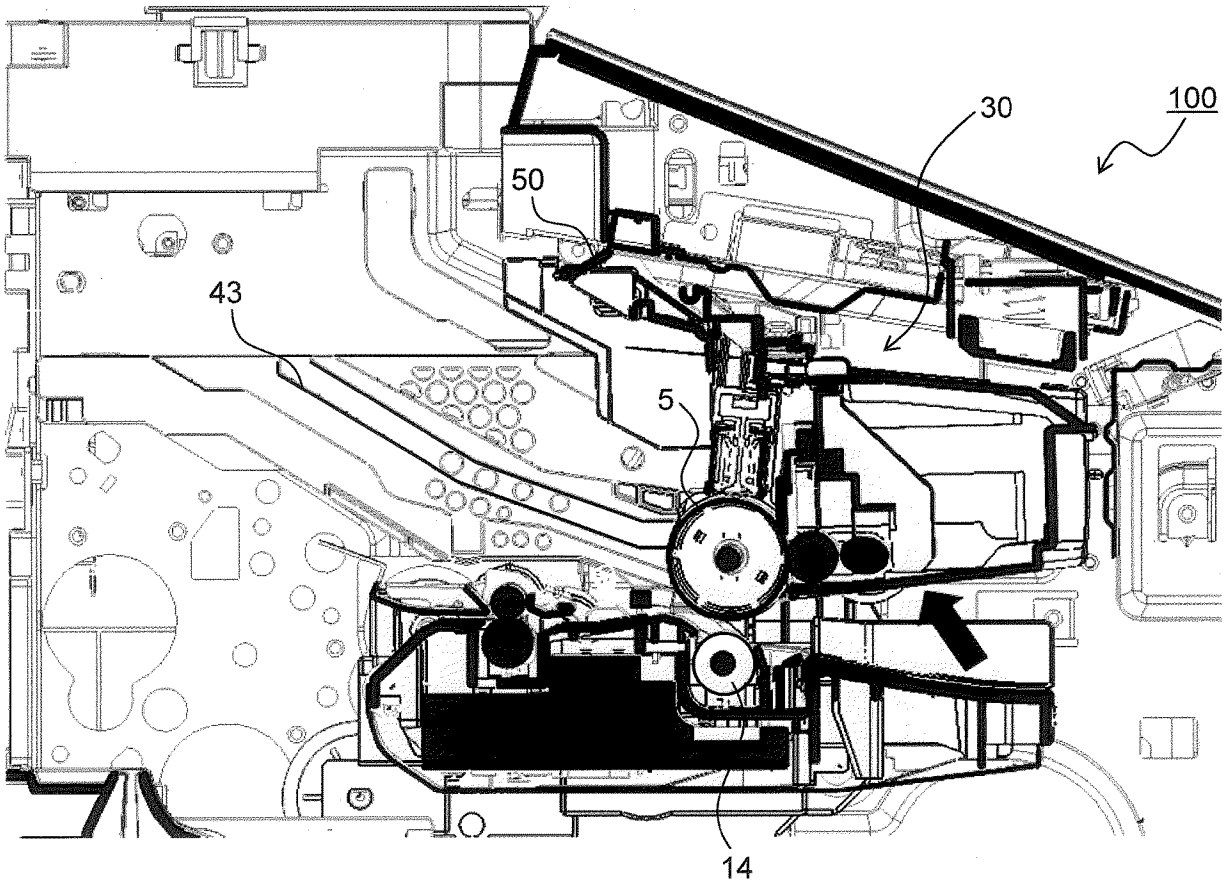
FIG. 4 is a side sectional view of the image forming apparatus in a state where a developing unit is removed.
Figure 5:
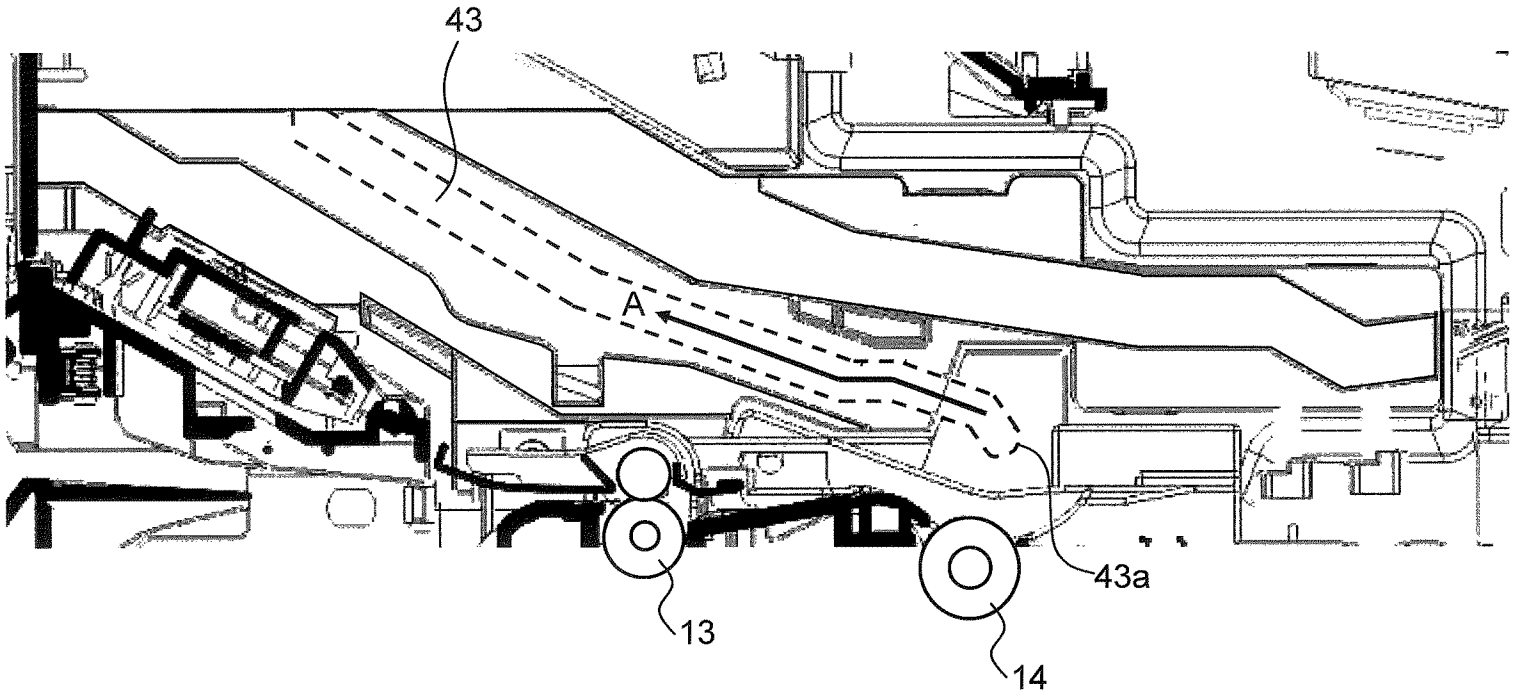
FIG. 5 is a side sectional view of guide grooves formed inside the image forming apparatus to allow insertion and removal of the drum unit.

FIG. 4 is a side sectional view of the image forming apparatus 100 in a state where the developing unit 60 (the developing device 8, the toner container 9) is removed, and FIG. 5 is a plan view of guide grooves 43 which are formed inside the image forming apparatus 100 to allow insertion and removal of the drum unit 30. When the drum unit 30 is inserted and removed relative to the image forming apparatus 100, drum bearings 45 (see FIG. 3), into which a rotary shaft 5*a* (see FIG. 3) of the photosensitive drum 5 is fitted, are engaged with the guide grooves 43. In downstream-side end parts of the guide grooves 43 in the insertion direction of the drum unit 30, positioning portions 43*a* are formed. With the drum unit 30 arranged in a mounting position inside the image forming apparatus 100, the rotary shaft 5*a* of the photosensitive drum 5 is arranged at the positioning portions 43*a*, and as shown in FIG. 1, the photosensitive drum 5 and the transfer roller 14 are in contact with each other to form a transfer nip portion.

When the openable cover 18*a* (see FIG. 1) is opened and the developing unit 60 is removed from the main body of the image forming apparatus 100, a pressing force from the developing unit 60 ceases to act on the drum unit 30, and thus the drum unit 30 moves to the upstream side (in the direction indicated by an arrow in FIG. 4) in the insertion direction along the guide grooves 43 by the action of a biasing force (restoring force) of coil springs (not shown).

As the drum unit 30 moves, the rotary shaft 5*a* of the photosensitive drum 5 leaves the positioning portions 43*a*, and is displaced in a direction away from the transfer roller 14. As a result, as shown in FIG. 4, the photosensitive drum 5 and the transfer roller 14 are brought out of pressed contact with each other. In this state, by gripping the grip portions 50 and removing the drum unit 30 in the direction indicated by arrow A (FIG. 5) along the guide grooves 43, it is possible to remove the drum unit 30 smoothly without scratching the photosensitive drum 5.

On the other hand, when the drum unit 30 is attached to the main body of the image forming apparatus 100, the drum unit 30 is inserted along the guide grooves 43. In this state, as shown in FIG. 4, the photosensitive drum 5 and the transfer roller 14 are apart from each other by the action of the coil springs. Subsequently, when the developing unit 60 is inserted, a pressing force from the developing unit 60 acts on the drum unit 30, and the rotary shaft 5*a* of the photosensitive drum 5 is arranged at the positioning portions 43*a*. As a result, the state shown in FIG. 1, where the photosensitive drum 5 and the transfer roller 14 are in contact with each other, is achieved.

As shown in FIG. 5, the insertion/removal trajectory of the drum unit 30 relative to the main body of the image forming apparatus 100 (the extension direction of the guide grooves 43) runs in the direction of a depression angle (obliquely downward) as seen from the operator, and the drum unit 30 is removed obliquely upward. However, when the operator removes the drum unit 30 without visually checking it or the guide grooves 43, he may try to remove the drum unit 30 in the horizontal direction, and this conventionally leads to a problem of the operator failing to remove the drum unit 30 smoothly along the guide grooves 43. In particular, in a case where the housing of the main body of the image forming apparatus 100 protrudes obliquely above the drum unit 30, the operator unconsciously tries to remove the drum unit 30 in the horizontal direction. To prevent that, in the drum unit 30 according to this embodiment, the grip portions 50 are so shaped as to guide the direction of removal of the drum unit 30 by the operator spontaneously along the insertion/removal trajectory.

Figure 6:
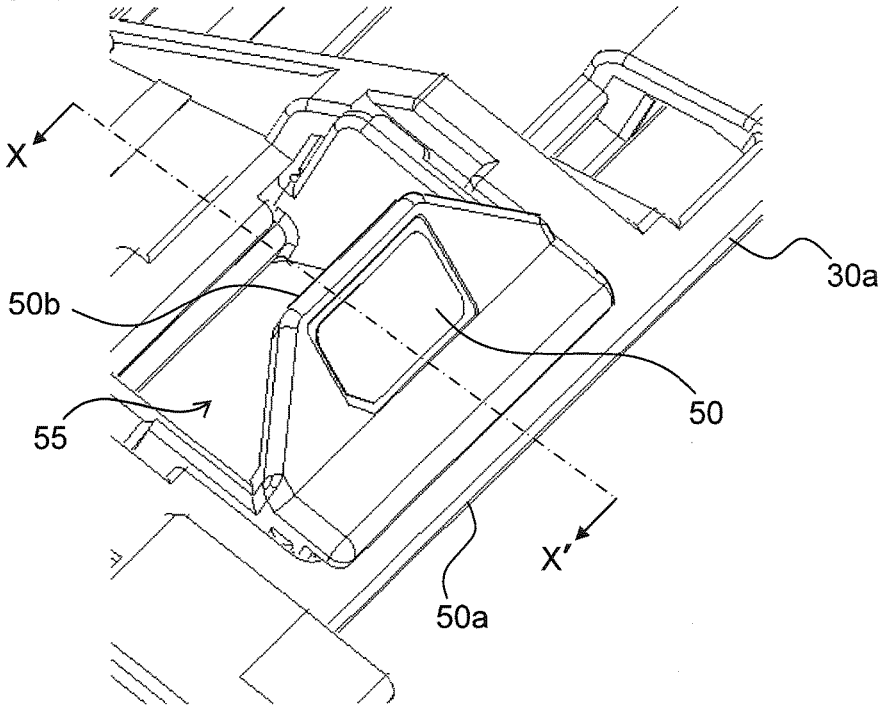
FIG. 6 is an enlarged perspective view of a grip portion formed in the drum unit according to the first embodiment.
Figure 7:
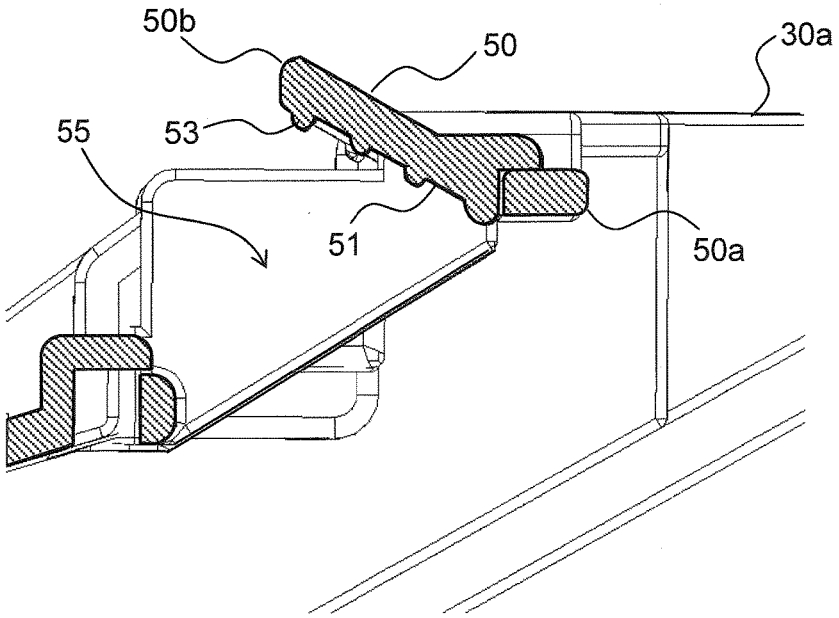
FIG. 7 is a side sectional view of the grip portion formed in the drum unit according to the first embodiment.

FIG. 6 is an enlarged perspective view of a grip portion 50 formed in the drum unit 30 according to the first embodiment, and FIG. 7 is a side sectional view (a sectional view along line XX' in FIG. 6 as seen from the direction indicated by arrows) of the grip portion 50. As shown in FIGS. 6 and 7, the grip portion 50 is formed so as to protrude obliquely upward from a downstream-side end part of the unit housing 30*a* in its removal direction.

The grip portion 50 has a pressed face 51 which faces the upstream side of the drum unit 30 in its removal direction. The pressed face 51 is an inclined face that is substantially perpendicular to the removal direction (direction indicated by arrow A in FIG. 5) of the drum unit 30. On the pressed face 51, a plurality of ribs 53 that extend in the horizontal direction (direction perpendicular to the plane of FIG. 7) are formed.

The grip portion 50 also has a first side 50*a*, which extends along the lower-end edge (edge on the near side as seen from the operator) of the pressed face 51, and a second side 50*b*, which extends along the upper-end edge (edge on the far side as seen from the operator) of the pressed face 51. No other face extending on the upstream side of the unit housing 30*a* in its removal direction connects to either the first or second side 50*a* or 50*b*, and adjacent to the pressed face 51, a through hole 55 (finger insertion portion) that penetrates from the first side 50*a* side to the second side 50*b* side is formed.

Figure 8:
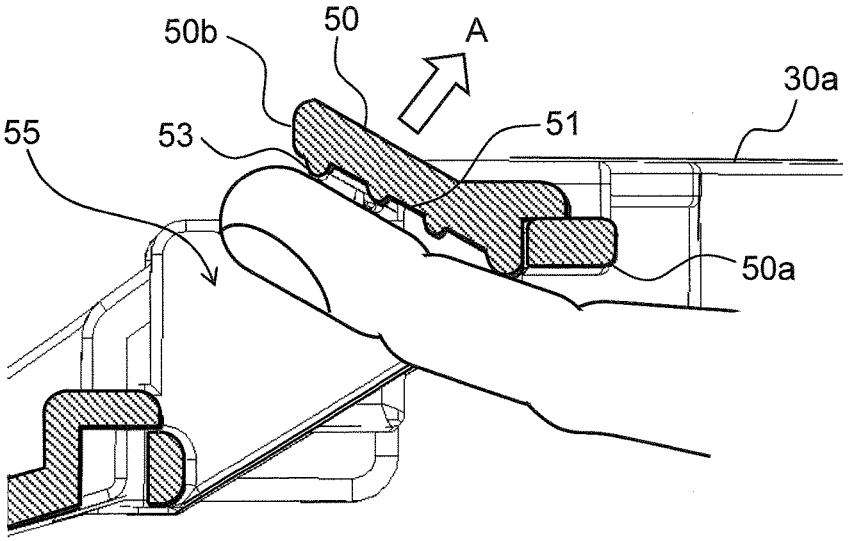
FIG. 8 is a side sectional view of the grip portion, showing how a pressed face is pushed up with a finger.

When the drum unit 30 is removed, as shown in FIG. 8, a finger is inserted into the through hole 55 from the first side 50*a* side (lower side) and is put on the pressed face 51. While the pressed face 51 is pushed up from below, the drum unit 30 is removed in the direction indicated by arrow A, which is the extension direction of the guide grooves 43.

With the structure according to this embodiment, since the pressed face 51 is substantially perpendicular to the removal direction of the drum unit 30, the operator can, by putting a finger on the pressed face 51, effortlessly apply to the drum unit 30 a force acting in the direction indicated by arrow A. That is, the pressed face 51 of the grip portion 50 is so shaped that the operator can unconsciously guide the drum unit 30 along the insertion/removal trajectory (guide grooves 43). Thus, even if the operator puts a finger on the grip portion 50 without visually checking the drum unit 30 or the guide grooves 43, he can remove the drum unit 30 smoothly in the direction indicated by arrow A along the guide grooves 43.

Moreover, since no other face connects to either the first side 50*a*, located below the pressed face 51, or the second side 50*b*, located above the pressed face 51, the operator can protrude the tip of a finger to above the upper end (second side 50*b*) of the pressed face 51. Thus, even if the pressed face 51 has a comparatively small area, the operator can put the finger firmly on the pressed face 51, and can push the pressed face 51 up with a sufficient force without a cramped feeling. Accordingly, the grip portion 50 can be formed in a small space, and this is especially useful in compact drum units 30.

Furthermore, the ribs 53 formed on the pressed face 51 provide an anti-slip function, and thus the operator can more firmly grip the grip portion 50.

Figure 9:
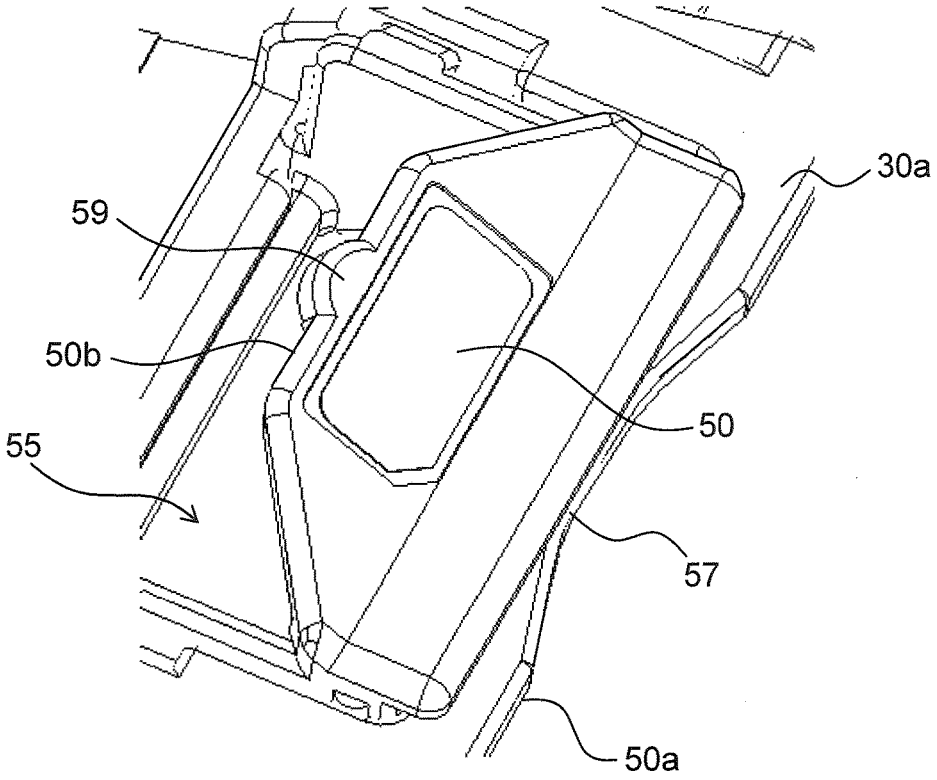
FIG. 9 is an enlarged perspective view of a grip portion formed in the drum unit according to a second embodiment of the present disclosure.

FIG. 9 is an enlarged perspective view of a grip portion 50 formed in the drum unit 30 according to a second embodiment of the present disclosure. In this embodiment, on the first side 50*a* located on the downstream side (near side as seen from the operator) in the removal direction of the drum unit 30, a cut portion 57 in the shape of an arc as seen in a plan view is formed. The cut portion 57 is formed in such a shape that the operator's finger inserted into the through hole 55 fits in it.

Moreover, on the second side 50*b* located on the upstream side (far side as seen from the operator) in the removal direction of the drum unit 30, a projecting portion 59 that projects in the shape of an arc is formed. In the other respects, the grip portion 50 is structured similarly as in the first embodiment.

Forming in the first side 50*a* the cut portion 57 in the shape of an arc such that a finger fits in it as in this embodiment permits the operator to insert the finger into the through hole 55 from the first side 50*a* easily by putting the finger along the cut portion 57. That is, the cut portion 57 has a function of leading the operator to grip the grip portion 50 from the first side 50*a* side.

Moreover, forming the projecting portion 59 on the second side 50*b* requires the operator, trying to insert a finger into the through hole 55 from the second side 50*b* side, to get over the projecting portion 59 and thereby makes it difficult to push the pressed face 51 up. Furthermore, with the drum unit 30 removed out of the main body of the image forming apparatus 100, when the operator puts a finger on the grip portion 50 from the second side 50*b* side, in a structure where there is little clearance between the housing of the image forming apparatus 100 and a top part of the drum unit 30, the housing of the image forming apparatus 100 obstructs the finger when the drum unit 30 is inserted, and makes it difficult to insert the drum unit 30. That is, the projecting portion 59 hampers the user trying to grip the grip portion 50 from the second side 50*b* side.

Thus, forming the cut portion 57 in the first side 50*a* and in addition forming the projecting portion 59 on the second side 50*b* permits a finger with which the operator intends to grip the grip portion 50 to be guided to the first side 50*a* side so that the finger can effortlessly grip the grip portion 50 from the proper direction.

Figure 10:
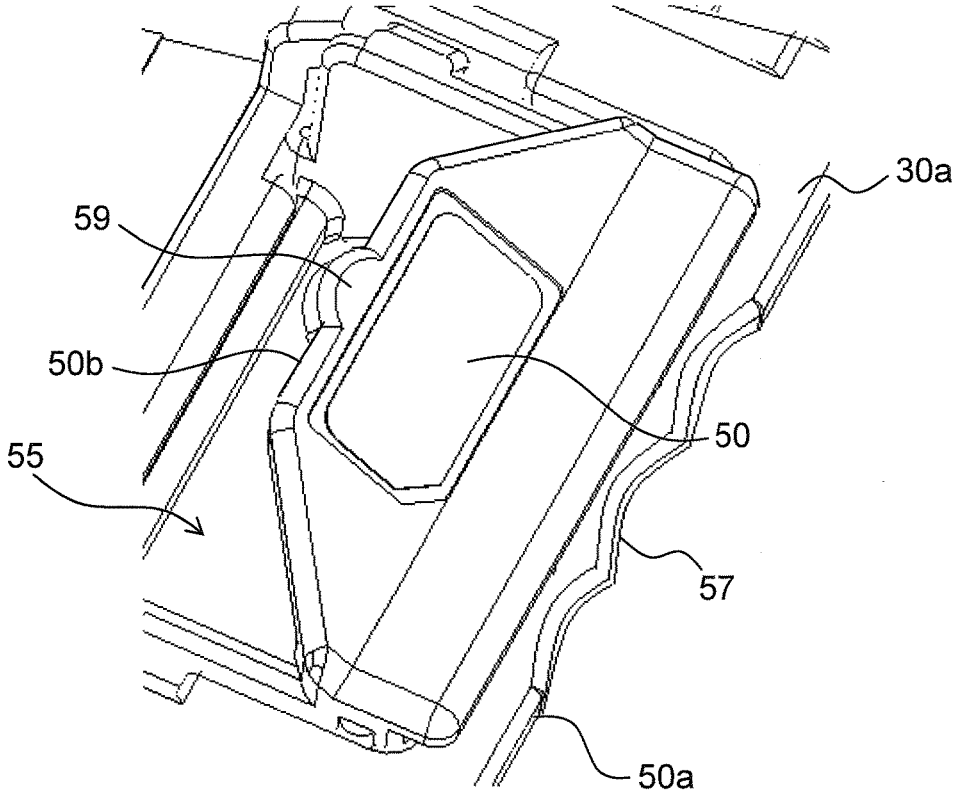
FIG. 10 is an enlarged perspective view showing another shape of a cut portion formed in the grip portion in the drum unit according to the second embodiment.

The cut portion 57 may be in any shape other than that of an arc; for example, as shown in FIG. 10, it may be in the shape of waves composed of a plurality of successive arcs that fit the balls of fingers. Likewise, the projecting portion 59 may be in any shape other than that of an arc; for example, forming it in a shape with a corner, such as in the shape of a triangle, helps enhance the effect of preventing insertion of a finger from the second side 50*b* side.

Figure 11:
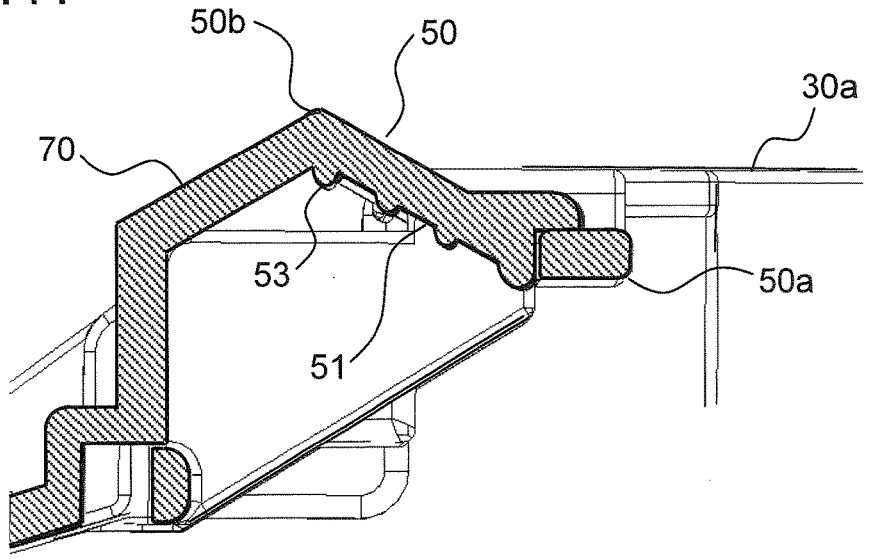
FIG. 11 is a side sectional view showing a modified example of the grip portion formed in the drum unit according to the present disclosure.

The present disclosure is not limited to the embodiments specifically described above, but allows for many modifications without departing from the spirit of the disclosure. For example, although the above embodiments deal with a structure where no other face extending on the upstream side of the unit housing 30*a* in its removal direction connects to either the first or second side 50*a* or 50*b*, a structure is also possible where, as shown in FIG. 11, a top face 70 extending on the upstream side of the unit housing 30*a* in its removal direction connects to the second side 50*b*. In the structure in FIG. 11, a finger inserted from the first side 50*a* side cannot protrude upward beyond the second side 50*b*, and accordingly the finger hooks on the pressed face 51 less firmly than in the first and second embodiments.

Although the above embodiments deal with a grip portion 50 formed on the drum unit 30 composed of the charging device 4, the photosensitive drum 5, and the cleaning device 19, the present disclosure finds application also in a gripping portion of any such removably attached units than the drum unit 30 as can be inserted into and removed from the image forming apparatus 100.

Needless to say, the present disclosure is applicable not only to monochrome printers like the one shown in FIG. 1 but also to image forming apparatuses of any other types provided with a detachable unit, such as color printers, monochrome and color copiers, digital multifunction peripherals, and facsimile machines.

The present disclosure is applicable to detachable units that can be inserted into and removed from the image forming apparatuses. According to the present disclosure, it is possible to provide a detachable unit that, even when the insertion/removal trajectory of the unit forms a depression angle as seen from the operator, can be removed smoothly along the insertion/removal trajectory.

What is claimed is:

1. A detachable unit comprising:

a unit housing; and a grip portion formed on the unit housing, wherein the grip portion has:

a pressed face facing an upstream side of the unit housing in a removal direction thereof and substantially perpendicular to the insertion/removal trajectory;

a first side extending along a lower-end edge of the pressed face; and a second side extending along an upper-end edge of the pressed face, no face extending on the upstream side of the unit housing in the removal direction thereof connects to the first side, and on an upstream side of the pressed face in the removal direction of the unit housing, a finger insertion portion into which a finger can be inserted from a side of the first side along the pressed face is formed in the first side, adjacent to the pressed face.

2. The detachable unit of claim 1, wherein a cut portion that fits a shape of the finger when inserted into the finger insertion portion from the side of the first side is formed in the first side.

3. The detachable unit of claim 2, wherein the cut portion is in a shape of an arc as seen in a plan view.

4. The detachable unit of claim 2, wherein the cut portion is in a shape of waves composed of a plurality of successive arcs.

5. The detachable unit of claim 1, wherein no face extending on the upstream side of the unit housing in the removal direction thereof connects to the second side, and the finger insertion portion is a through hole penetrating from the first side to the second side along the pressed face.

6. The detachable unit of claim 5, wherein a projecting portion that prevents the finger from being inserted into the finger insertion portion from a side of the second side is formed on the second side.

7. The detachable unit of claim 1, wherein a plurality of ribs extending in a horizontal direction are formed on the pressed face.

8. An image forming apparatus comprising:

the detachable unit of claim 1;

an image forming section for forming a toner image; and a guide groove constituting the insertion/removal trajectory.

9. The image forming apparatus of claim 8, wherein an extension direction of the guide groove is a direction of a depression angle as seen from an operator, and the detachable unit is removed obliquely upward along the guide groove.

10. A detachable unit comprising:

a unit housing; and a grip portion formed on the unit housing, wherein the grip portion has:

a pressed face facing an upstream side of the unit housing in a removal direction thereof and substantially perpendicular to the insertion/removal trajectory;

a first side extending along a lower-end edge of the pressed face; and a second side extending along an upper-end edge of the pressed face, no face extending on the upstream side of the unit housing in the removal direction thereof connects to the first side, a finger insertion portion into which a finger can be inserted from a side of the first side along the pressed face is formed in the first side, no face extending on the upstream side of the unit housing in the removal direction thereof connects to the second side, the finger insertion portion is a through hole penetrating from the first side to the second side along the pressed face, and a projecting portion that prevents the finger from being inserted into the finger insertion portion from a side of the second side is formed on the second side.

* * * * *